US007665538B2

(12) United States Patent
Robisson et al.

(10) Patent No.: US 7,665,538 B2
(45) Date of Patent: Feb. 23, 2010

(54) SWELLABLE POLYMERIC MATERIALS

(75) Inventors: Agathe Robisson, Cambridge, MA (US); Partha Ganguly, Belmont, MA (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 11/610,134

(22) Filed: Dec. 13, 2006

(65) Prior Publication Data

US 2008/0142221 A1 Jun. 19, 2008

(51) Int. Cl.
*E21B 33/12* (2006.01)

(52) U.S. Cl. ..... 166/387; 166/118; 166/135; 166/192; 166/386

(58) Field of Classification Search ..... None
See application file for complete search history.

(56) References Cited

U.S. PATENT DOCUMENTS

| | | | | |
|---|---|---|---|---|
| 5,613,557 | A | 3/1997 | Blount et al. | |
| 5,833,001 | A | 11/1998 | Song et al. | |
| 6,102,120 | A | 8/2000 | Chen et al. | |
| 6,820,690 | B2 | 11/2004 | Vercaemer et al. | |
| 6,848,505 | B2 | 2/2005 | Richard et al. | |
| 6,935,432 | B2 | 8/2005 | Nguyen | |
| 2005/0199401 | A1 | 9/2005 | Patel et al. | |
| 2006/0122071 | A1 * | 6/2006 | Reddy et al. | 507/219 |
| 2007/0027245 | A1 * | 2/2007 | Vaidya et al. | 524/424 |

FOREIGN PATENT DOCUMENTS

| | | | |
|---|---|---|---|
| EP | 1315883 | B1 | 6/2003 |
| WO | 2003008756 | A1 | 1/2003 |
| WO | 2005012686 | A1 | 2/2005 |

* cited by examiner

*Primary Examiner*—Zakiya W. Bates
(74) *Attorney, Agent, or Firm*—Brigid Laffey; James McAleenan; Helene Raybaud

(57) ABSTRACT

A seal comprising a polymeric material having a first swelling phase having a first swelling characteristic and a second swelling phase having a second swelling characteristic, the first swelling characteristic is greater than the second swelling characteristic is utilized to seal an upper portion from a lower portion of a wellbore. A wellbore seal tool is further described comprising a swellable layer, a supporting assembly disposed adjacent the swellable layer, and an inflatable bladder.

19 Claims, 5 Drawing Sheets

SWELLABLE POLYMERIC MATERIALS

BACKGROUND OF INVENTION

1. Field of Invention

This invention relates to polymeric materials typically used in oilfield applications and environments and, more particularly, to systems and techniques utilizing swellable polymeric materials in downhole environments to seal least a portion of a wellbore.

2. Discussion of Related Art

Bosma, et al., in International Application Publication No. WO 2003/008756, disclose a wellbore system comprising borehole extending into an earth formation, a tubular element extending into the borehole. A cylindrical wall surrounds the tubular element such that annular space is formed between the tubular element and the cylindrical wall. At least one seal member is in the annular space and is movable between a retracted mode such that the seal member has a first volume and an expanded mode in which the seal member has a second volume that is larger than the first volume. In the expanded mode, the seal member seals the annular space. The seal member includes a material that swells upon contact with a selected fluid.

Vercamer, et al., in U.S. Pat. No. 6,820,690, disclose a technique for the use of a variety of completion elements in a wellbore environment. The technique involves an insertion guide disposed within an open hole section of a wellbore. The insertion guide may be radially expanded towards the surrounding formation to remove excess annular space.

Richard, et al., in U.S. Pat. No. 6,848,505, disclose a method of sealing casing or liners in a wellbore. Stands of casing or liner receive a jacket bonded to an outer surface. The jacket is a rubber compound bonded to the outer wall. The rubber formulation responds to well fluids by swelling at a predetermined rate. The casing or liner can also be expanded with a swage prior to the onset of significant jacket swelling.

Patel, et al., in U.S. Patent Application Publication No. 2005/0199401, disclose a sealing system used seal an exterior surface of a casing or open wellbore. The sealing system includes a swellable material that swells from an unexpanded state to an expanded state thereby creating a seal when the swellable material comes in contact with a triggering fluid.

Bosma, et al., in International Application Publication No. WO 2005/012686, disclose a system for sealing a space in a wellbore formed in an earth formation. The system includes a swellable body arranged in the wellbore to seal the space upon swelling of the swellable body. The swellable body is susceptible to formation water flowing into the wellbore. The swellable body includes a matrix material with a compound soluble in the formation water. The matrix material substantially prevents or restricts migration of the compound out of the swellable body and allows migration of the formation water into the swellable body by osmosis.

Nguyen, in U.S. Pat. No. 6,935,432, disclose an apparatus and method of utilizing an expandable media assembly to create an annular barrier in a subterranean well. The apparatus has a tubing assembly placed in the wellbore such that an annular space is formed between an outer surface of the tubing assembly and the wellbore. The apparatus has an expandable media assembly having an expandable material which is initially in a run-in position and is capable of increasing in volume to a set position in the wellbore thereby creating an annular barrier blocking fluid flow along the annular space. The expandable material can be a foam, gel, or alloy. The media can be deformable upon enlargement and conform to the wellbore wall. The media can be a sleeve secured to the tubular assembly or a medium carried in a pressurized canister for release at a selected downhole location. The media can be thermally, chemically, or otherwise activated to expand and can be used in conjunction with radially expandable screen assemblies and tubing assemblies.

Freyer, in European Patent Specification No. EP 1 315 883, disclose a well packing for sealing an annular space between a well wall and a production tubing, comprising an expandable element mainly consisting of rubber material. The packer has a first elastomer adapted to swell when exposed to hydrocarbons, and a second elastomer disposed externally to the first elastomer.

The above listed references fail to provide a readily deployable seal requiring minimal actuation to effect a seal in a wellbore. Furthermore, the above listed references fail to address the control of the mechanical properties and swelling kinetics through the use of a polymeric material. Accordingly, it is an object of the present invention to addresses these limitations of the prior art through the polymeric seal recited herein.

SUMMARY OF THE INVENTION

In accordance with one or more embodiments, the invention relates to a wellbore seal comprising a polymeric material having a first phase with a first swelling characteristic, and a second phase with a second swelling characteristic. The first swelling characteristic is greater than the second swelling characteristic when the polymeric material is exposed to a formation fluid.

In accordance with one or more embodiments, the invention relates to a wellbore seal tool comprising a swellable layer, a supporting assembly disposed adjacent the swellable layer, and an inflatable bladder. The swellable layer can comprise a polymeric material having a first phase having a first swelling characteristic and a second phase having a second swelling characteristic such that the first swelling characteristic is greater than the second swelling characteristic when exposed to a formation fluid in the wellbore.

In accordance with one or more embodiments, the invention relates to a method of sealing an upper portion from a lower portion of a wellbore having a production tubing assembly disposed therein. The method may include disposing a swellable polymeric material against an outer surface of the production tubing assembly and a wall of the wellbore, the swellable polymeric material comprising a first phase having a first swelling characteristic and a second phase having a second swelling characteristic, and promoting a bulk volumetric increase of the polymeric material to seal the upper portion from the lower portion. When the swellable material is exposed to a formation fluid, the first swelling characteristic is greater than the second swelling characteristic In accordance with one or more embodiments, the invention relates to a method of sealing at least a portion of a wellbore. The method can further include disposing a swellable polymeric material against at least a portion of a wall of the wellbore, and supporting the swellable polymeric material against the portion of the wall with a support assembly. The swellable polymeric material can comprise a first phase having a first swelling characteristic and a second phase having a second swelling characteristic, the first swelling characteristic is greater than the second swelling characteristic.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing.

In the drawings.

DETAILED DESCRIPTION

Figure 1:
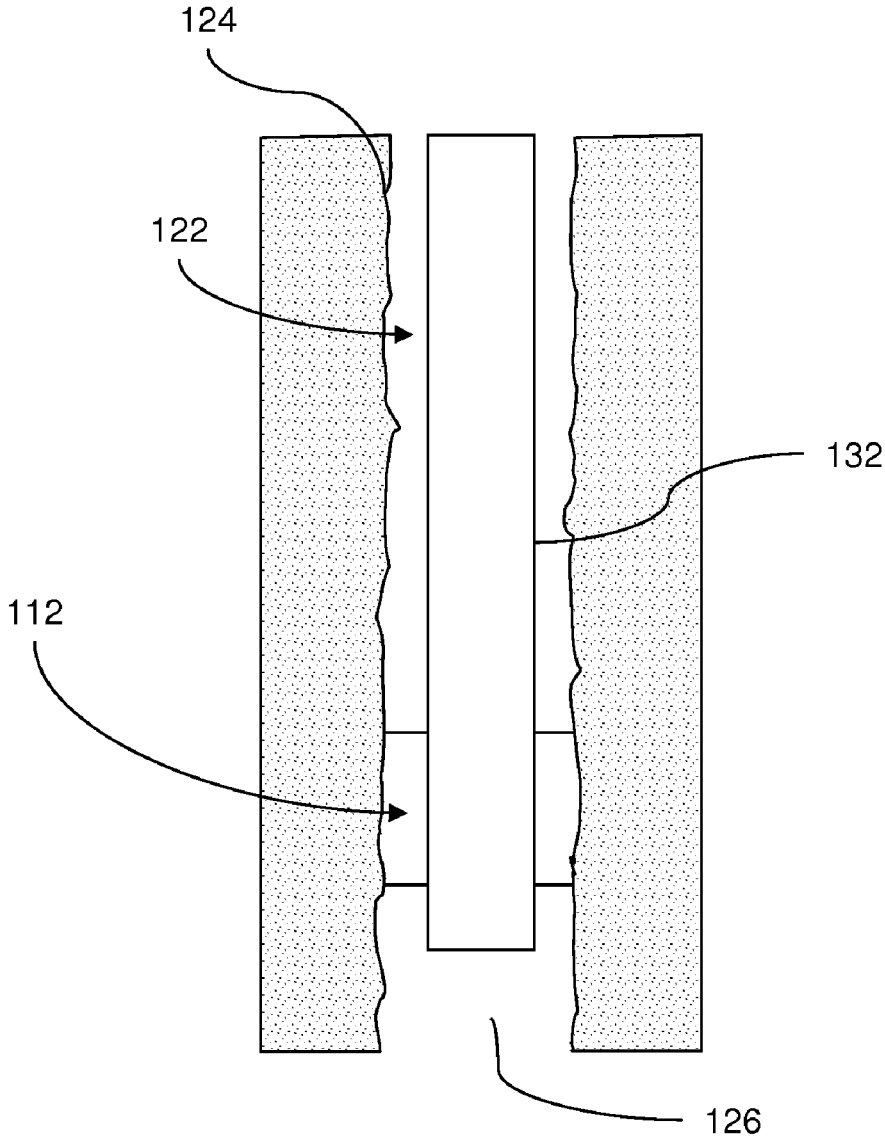
FIG. 1 is a schematic illustration showing a wellbore sealing system in accordance with one or more embodiments of the invention.

This invention is not limited in its application to the details of construction and the arrangement of components set forth in the following description or illustrated in the drawings. The invention is capable of embodiments and of being practiced or of being carried out in various ways beyond those exemplarily presented herein.

Some aspects of the invention pertain to oilfield systems and, in some cases, to sealing at least a portion of a subsystem or component of a unit operation in an oilfield. One skilled in the art will recognize that the present invention has numerous non-oilfield applications. Thus, although some aspects of the present invention are directed to sealing a wellbore, the various components and techniques of the invention are not limited as such and may be implemented in other facilities. For the purpose of clarity, the present invention will be described as capable of sealing a "wellbore". As used herein, "wellbore" shall be defined as any contained fluid or gas passage, including but not limited to fluid passages above and below ground. Furthermore, the terms "formation fluid" and "swelling fluid" shall include all fluids within the wellbore and in contact with the swellable polymetric material of the present invention. One or more aspects of the invention pertain to downhole or well casing sealing systems and techniques. As exemplarily illustrated in the cross-sectional schematic diagram in FIG. 1, the sealing system of the invention can provide at least one seal 112 disposed in a space 122 typically defined between a wall 124 of a wellbore 126 and a downhole tubing assembly 132. In accordance with the present invention, the downhole tubing assembly 132 may include, but is not limited to, a cased hole, a production tubing setting, or an open hole. One skilled in the art will recognize that numerous other downhole tubing assemblies 132 are directly applicable to the present invention. Seal 112 typically serves to fluidly isolate a first or upper section from a second or lower section of the wellbore 126 so that formation fluid (not shown) in the wellbore is directed into, rather outside of, tubing assembly 132.

The sealing systems and techniques of the invention can utilize one or more materials that respond to conditions in the service environment. The responsive materials can be disposed or placed in service by utilizing supporting components that can be deployed to position the one or more responsive materials. Further components or subsystems of the sealing systems of the invention can include actuating mechanisms and/or securing systems that ensures deployment and positioning of the one or more sealing systems of the invention.

Figure 2:
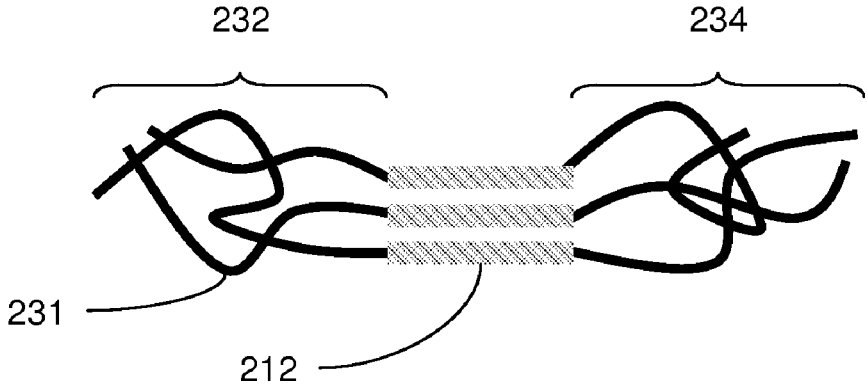
FIG. 2 is a schematic representation of a polymeric material in accordance with one or more embodiments of the invention.
Figure 3:
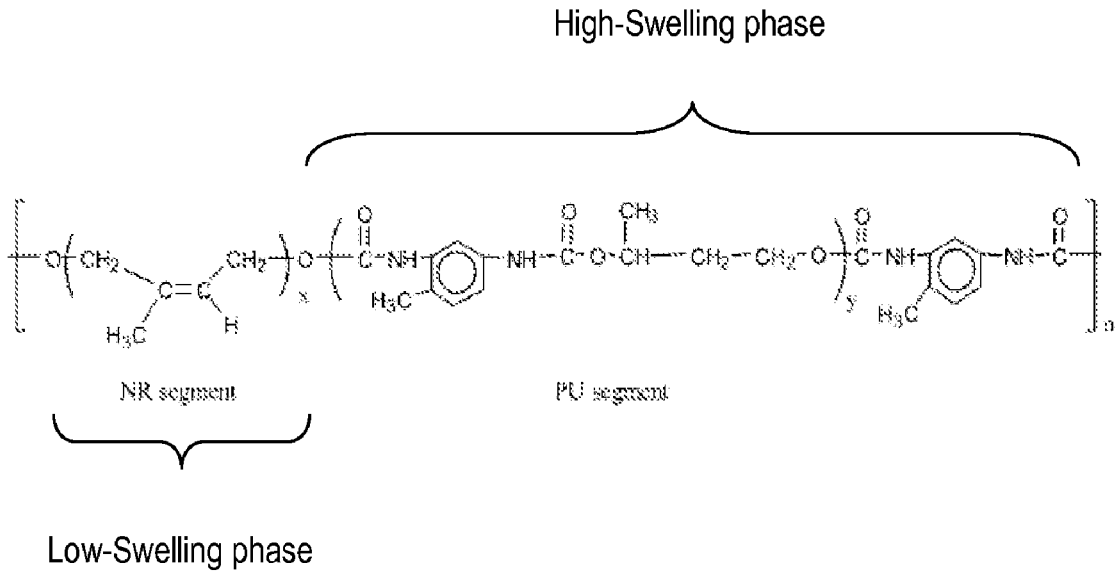
FIG. 3 is a formulaic representation of a polymer in accordance with one or more embodiments of the invention.

In some cases, the polymeric material can have at least one first component that volumetrically changes and at least one second component that is relatively volumetrically inert or constant compared to the first component, when the composite polymeric material is disposed in the wellbore environment or at least exposed to at least one component of formation fluid typically present in the wellbore. For example, the invention can be facilitated by utilizing one or more swellable polymeric materials and one or more expandable mesh-linked structures. As exemplarily illustrated in FIG. 2, a first segment of the polymeric material can comprise one or more swellable segments 232 and 234 and a segment can comprise one or more non-swelling segments 212. It is noted that one or more first and second segments may be used in practicing the present invention. The polymeric material can comprise a composite or mixture of a plurality of first and second segment and, as illustrated in FIG. 3, particularly advantageous embodiments of the invention involve polymeric materials comprising a copolymer derived from at least one low-swelling monomer forming at least a portion of a low-swelling phase and at least one high-swellable monomer forming at least a portion of a high-swelling phase, wherein the low-swelling monomer exhibits lower swelling characteristics relative to the high-swelling monomer. The mixture can be as a copolymer of at least one swellable segment and, optionally, a non-swelling segment. The mixtures can be blends involving mechanically mixed segments as well as a plurality of segments chemically stabilized by, for example, copolymerization, or by crosslinking. For example, one or more swellable segments can be chemically bonded with one or more of any a non-swelling segments and a different swellable segment, through a compound having a pendant unsaturated diene bonds.

Any material that can absorb at least a portion of at least one component of formation fluid can comprise the first, swellable component. The second component, namely a component exhibiting no or minimal swelling as compared to the first swellable component, is not limited to volumetrically inert materials and, in some embodiments of the invention, the second component can comprise a lower swelling material, compared to the first, high swelling material. Indeed, in some advantageous embodiments of the invention, the composite polymeric material comprises a first, high swelling phase, a second, intermediate swelling phase, and a third, low swelling phase. Further embodiments that can be implemented in the systems and techniques of the invention utilize a plurality of swellable phases, each of which preferentially adsorb at least one particular component of the formation fluid.

The swellable materials of the invention can volumetrically expand to greater than about 100% or even to greater than about 200% relative to the initial condition. Preferably, however, the material swells by at least 10% and more preferably by at least about 20%, within one day.

In some embodiments of the invention, the composite material, comprising at least one non-swelling component and at least one swellable component, exhibits improved mechanical physical properties.

In accordance with still further embodiments of the invention, the polymeric material has a plurality composite swelling behaviors or characteristics depending on the absorbed component. For example, the polymeric materials of the invention can have a first swelling characteristic, under a first set of exposure conditions, e.g., temperature, in response to exposure to and/or as a result of absorption of a first component or a first set of components of the formation fluid, and a second swelling characteristic, under the same or a different set of exposure conditions, in response to exposure to a second component or a second or different set of components in the formation fluid. For example, the polymeric materials of the invention can comprise a first swellable phase that volumetrically increases when exposed to water and/or aqueous solutions and a second swellable phase that volumetrically increase when exposed to hydrocarbon liquids. One or more optional phases can also be utilized, in place of or in conjunction with the first and/or second phases, which volumetrically increases in response to exposure to aqueous or non-aqueous liquids.

Some particularly advantageous embodiments of the invention involve a plurality of composite polymeric materials, each of which has at least one swelling characteristic. The plurality of composite materials can be embodied as a layered structure with a first polymeric layer having a first swelling characteristic, a second polymeric layer having a second swelling characteristic, and optionally, a third polymeric layer having a third swelling characteristic or the same swelling characteristic as any one of the first and second polymeric layers. For example, the first layer can have a first rate of volumetric change when exposed to aqueous liquids and the second layer can have a second rate of volumetric change when exposed to aqueous liquids. In embodiments wherein the first polymeric material of the first layer has a lower rate of volumetric increase than the second polymeric material of the second layer, then the system can be deployed within a wellbore in a controlled manner.

Moreover, further embodiments of the invention can involve one or more triggering or activating events. Thus, in some cases, the swelling phenomena of the polymeric materials of the invention can be controllably initiated at a predetermined time or under at least one initiating condition thereby flexibly allowing for controlled deployment of the systems of the invention. Such features facilitate positioning the various components and subsystems of the invention at desired locations, rather than at random or even undesirable locations. Thus, in some cases, the polymeric material can have a first exposed layer of material that serves as a barrier and prevents or at least reduces the extent of exposure of the underlying composite polymeric material to formation fluid. For example, the barrier layer can comprise a water soluble material that degrades and/or dissolves in a fluid having at least one aqueous component. The barrier layer can thus comprise any water soluble material such as, but not limited to, salts, cellulose, carbohydrates, and mixtures thereof. The barrier layer however, may comprise insoluble materials. Indeed, some embodiments of the invention can utilize a barrier layer comprising a material that selectively or preferentially allows a first type of component of the formation fluid over other components of the formation fluid. For example, the barrier layer can comprise a hydrophobic material that provides a higher diffusion rate therethrough of non-aqueous liquids over aqueous liquids. Alternatively, the barrier layer can comprise a material that the provides a higher diffusion rate of aqueous liquids over non-aqueous liquids.

Non-limiting examples of segments or components that can comprise at least a portion of the swellable or high swelling phase include, polyisoprene, polyisobutylene, polybutadiene, polystyrene, poly(styrene-butadiene), polychloroprene, polysiloxane, poly(ethylene-propylene), chorosulfonated polyethylene, and/or precursors, mixtures, or derivatives thereof. Non-limiting examples of segments or components that can comprise at least a portion of non-swellable or low swelling phases include polyacrylate, polyurethane and poly(acrylonitrile-butadiene), hydrogenated poly(acrylonitrile-butadiene), polyepichlorohydrin, polysulfide, fluorinated polymers, and/or precursors, mixtures, or derivatives thereof. However, because the swelling phase is relative to a non-swelling phase, or even to another phase having a phase exhibiting lower swelling kinetics, the particularly disclosed polymeric materials are not limited as such. For example, a polymeric material of the invention can have a first low-swelling phase comprising a fluorinated polymer and a high swelling phase comprising polyurethane because the polyurethane would typically exhibit lower swelling characteristics relative to the fluorinated polymer when exposed to a swelling fluid comprising oil.

Figure 4:
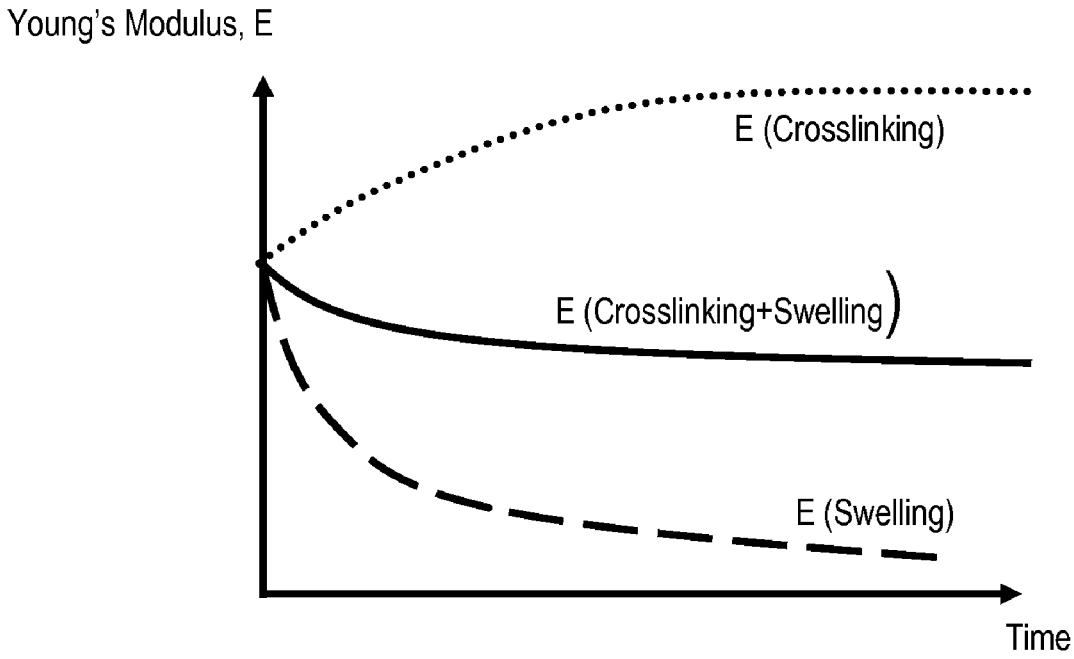
FIG. 4 is a chart graphically illustrating a desirable kinetic characteristic of a material in accordance with one or more embodiments of the invention.

Selection of the polymeric materials of the invention can also involve considerations relating to its elastic behavior. For example, the polymeric material can be at least partially crosslinkable. The polymeric material can then be formulated to include one or more crosslinking agents or crosslinkers that affects the bulk characteristics of the material without inhibiting swelling kinetics. As exemplarily illustrated in FIG. 4, the Young's modulus of a polymeric material typically increases with crosslinking but decreases with swelling. Preferentially, the rate of crosslinking, typically at the exposure or in service conditions, maintains or at least reduces any decrease in bulk material modulus resulting from the swelling phenomena. Tailoring the crosslinking kinetics can be effected by adding selected crosslinking agents and/or by adjusting the concentration or amount of the crosslinking agent in the polymeric matrix. Non-limiting examples of crosslinking agents include sulfur, sulfur-containing compounds, organic peroxides and/or mixtures thereof as well compounds that can liberate free radical species that react with unsaturated bonds on the polymeric chains. Further, crosslinking accelerator and/or retarders can also be utilized. For example, stearic acid, zinc oxide, and/or substituted benzothiazole sulfonamides can be used as accelerators and/or activators, and nitrosodiphenylamines can be used as retarders in polyisoprene/poly(styrene-butadiene) based polymeric blends utilizing sulfur as a predominant crosslinking agent.

The composite polymeric materials of the invention can also be formulated to include any material that desirably affects the bulk characteristics thereof during processing, assembly, deployment, and/or use. For example, the polymeric compounds can comprise at least one reinforcing agent that imparts or improves the mechanical characteristics thereof. Non-limiting examples of reinforcing agents include carbon black as well as silica. Other optional formulaic components of the polymeric materials of the invention can include softeners and/or processing aids that provide advantageous bulk Theological properties and aid in processing the polymeric material during formulation and assembly. For example, wax can be used to aid in mixing, extrusion, and/or molding operations, and in some cases, to produce tack and further facilitate assembly.

Figure 5:
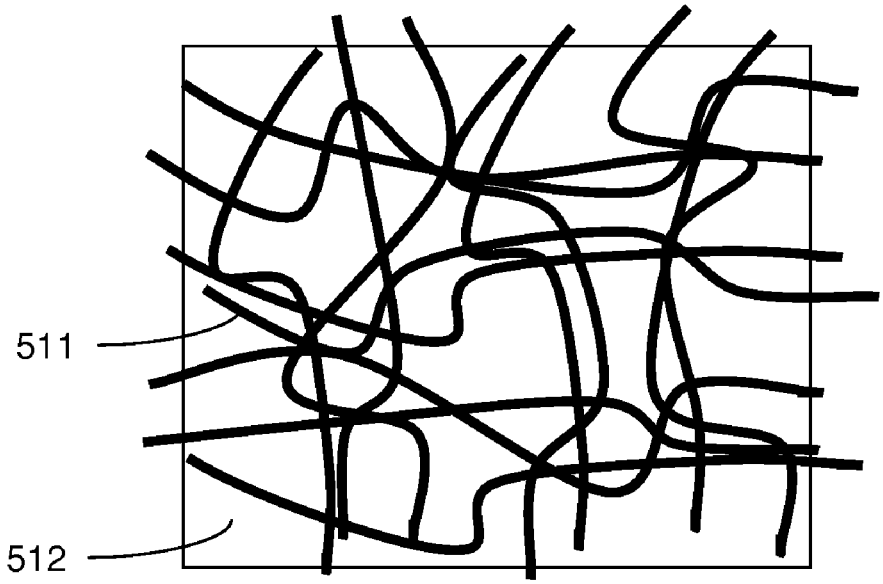
FIG. 5 is a schematic representation of a composite material in accordance with one or more embodiments of the invention.

Some embodiments of the polymeric materials of the invention comprise one or more components or phases that facilitate transport of the swelling liquid. As exemplarily illustrated in FIG. 5, the composite polymeric material can have one or more channels 511 that can preferentially transport the swelling fluid through the bulk of the polymeric matrix 512 thereby providing conduits that deliver the swelling fluid below the formation-exposed surface of the composite polymeric material. Such structures can advantageously be used to tailor the swelling characteristics of the system. As illustrated in FIG. 5, channels 511 are randomly dispersed throughout the bulk matrix 512 providing a polymeric material that has isotropic characteristics, or at least one layer thereof. However, several embodiments of the invention can involve composite polymeric structures that exhibit anisotropic tendencies. For example, the channels can be preferentially or predominantly oriented to extend longtitudinally from the exposed surface into the bulk of the matrix. In some embodiments of the invention, the polymeric material can a first polymeric layer with a first density of first channels that are in a substantially parallel orientation relative to the exposed surface, and a second polymeric layer with second channels oriented to be substantially perpendicular to a long axis of the first channels. Various configurations and combinations of such orientations can be utilized in one or more embodiments of the invention. Indeed, the density, size, and/or composition of the channels of the invention can be tailored to advantageously provide desirable swelling characteristics. The channels can comprise any material that transports or provides accelerates a diffusion rate of the swelling fluid, which can be aqueous or non-aqueous liquids, into the polymeric material matrix. For example, the channels can materials that transport aqueous liquids including, but not limited to, natural and synthetic cellulose-based substances, carbohydrates, fabrics or textiles, and blends or combinations thereof.

Figure 6:
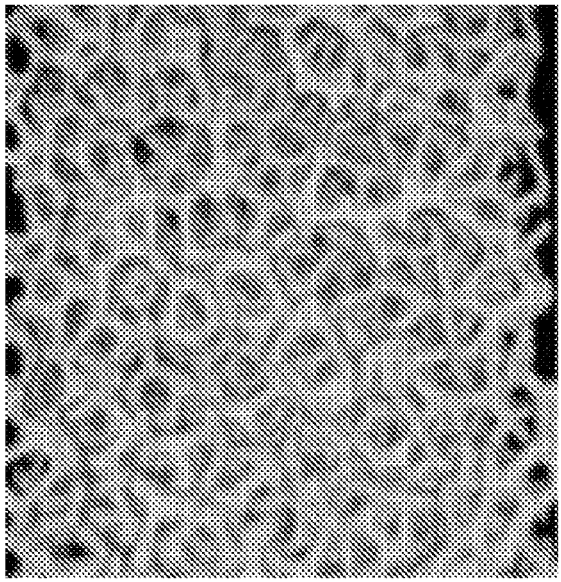
FIG. 6 is a schematic representation of a reticulated or porous material that can be utilized in one or more embodiments of the invention.

Still further aspects of the invention can involve polymeric materials that comprise at least one partially porous phases. For example, the polymeric materials of the invention can utilize a porous network as illustrated in the copy presented as FIG. 6. The reticulated porous material can be used to facilitate transport of the swelling fluid into the swelling polymeric material matrix. Any pore size and/or degree of porosity can be utilized in various embodiments of the invention. Non-limiting examples of such porous structures include reticulated ceramic materials or metals. Moreover, the porous phases can be deployed within the polymeric matrix in any shape and can be, for example, deployed as channels as described above.

In further embodiments of the invention, a composite structure can be utilized. The composite polymeric material can have at least one foam layer of polymeric material that has open and/or closed cell. The foam polymeric layer can be prepared by incorporating one or more blowing agents during formulation and preparation thereof. The blowing agents liberate a gas upon activation. In other cases, the structure can be rendered porous by incorporating soluble bodies within the matrix. Upon exposure to a solvent, which can be aqueous or non-aqueous, the soluble bodies are dissipated leaving pores in the matrix. Examples of materials that can be utilized accordingly include salts and sugars.

Figure 7:
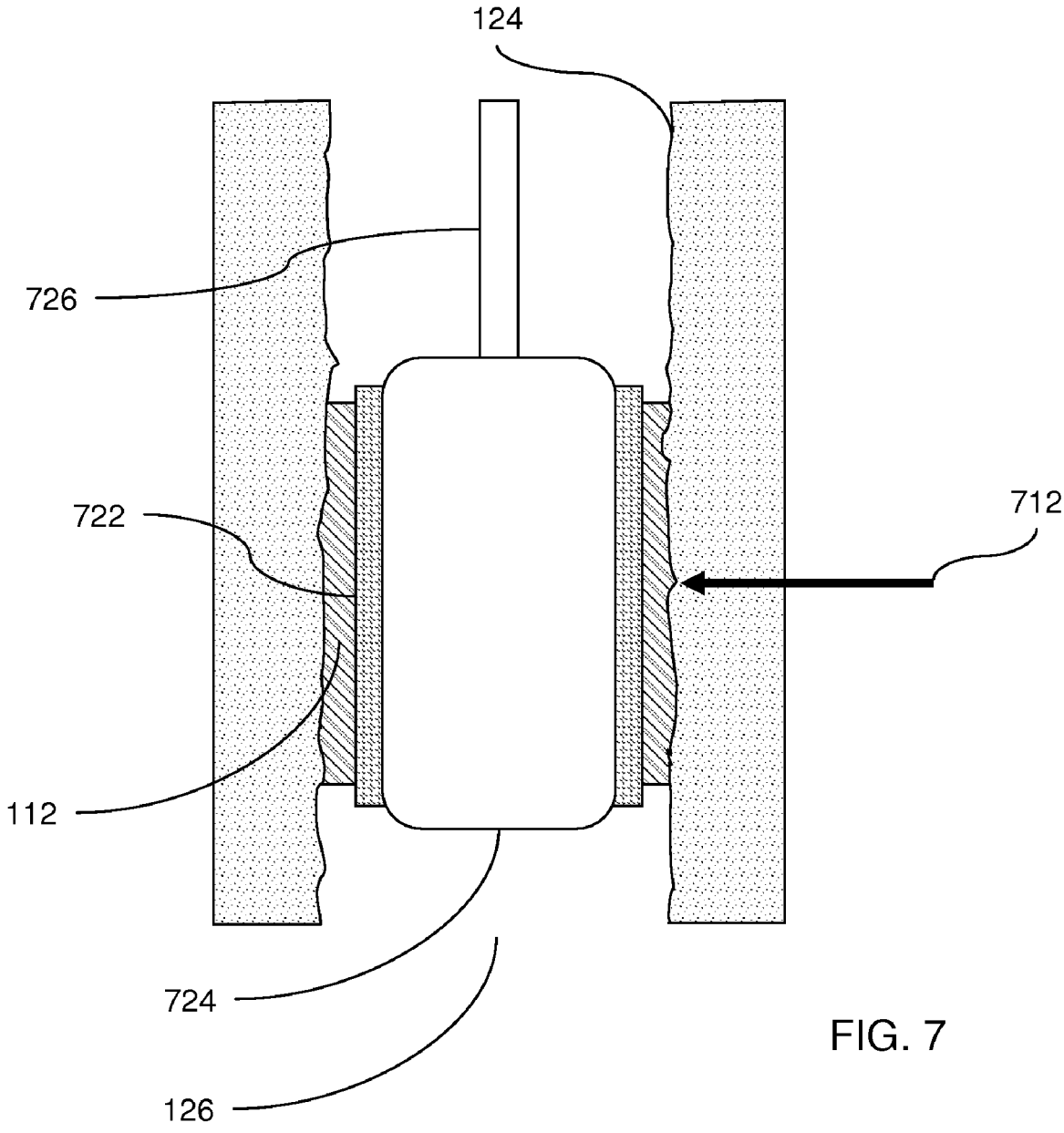
FIG. 7 is a schematic illustration of a seal assembly shown disposed in a wellbore and comprising a swellable material, a support assembly, and bladder in accordance with one or more embodiments of the invention.

FIG. 7 schematically illustrates further aspects of the invention. As exemplarily illustrated, the systems and techniques of the invention can involve sealing a portion of a well bore and prevent or at least partially inhibit flow of formation fluid, generally represented as reference 712, into a wellbore 126. The sealing systems and techniques of the invention can involve utilizing at least one polymeric sealant 112 comprising at least one swellable polymeric material which typically exhibits a swelling characteristic in response to exposure to one or more swelling fluids, as described above. Optionally, a supporting scaffolding structure 722 may deployed to at least partially impart rigidity to the polymeric sealant when the aggregate assembly is disposed against walls 124 of wellbore 126.

The supporting scaffolding 722 can comprise a structure that deformably expands against polymeric sealant 112 thereby securing the sealant against wall 124. non-limiting examples of scaffolding structures 722 include wire mesh assemblies. Preferably, a plurality of layer of wire mesh assemblies can be utilized in, for example, an overlapping or concentric fashion, to contain the sealant.

Support 722 can be deployed by any technique that plastically deforms the material thereof. For example, support 722 can comprise a plurality of annular wire mesh layers concentrically oriented to expand when a centrally disposed bladder 724 is inflated thereby expanding the plurality of wire mesh layer of support 722. Inflation or activation of bladder 724 can be effected by introducing a pressurizing fluid, gas or liquid, through port 726. Sealant 112 is then disposed against and preferably compressed against wall 124 as a result of the volumetric expansion of bladder 724 along with support 722. Bladder 724 can then be de-energized by releasing the applied pressure. Energizing and de-energizing the bladder can be performed several times. De-energized bladder 724 can then be withdrawn leaving the sealant against wall 124, which is further secured by support 722. The sealant and support assembly thus prevents or at least inhibits undesirable formation fluid entry into the wellbore.

Deployment and positioning of the sealant/support assembly is not limited to utilizing inflatable bladders and can be effected by utilizing expandable plugs or mandrels. Such assemblies can utilize cams or similar asymmetric components actuatable pneumatically, hydraulically or by electromechanical assemblies. Energizing the bladder or mandrels can be triggered and/or effected at a surface-level or subsurface facility. For example, compressed can be delivered from a compressed air station disposed on a surface or from a subsurface disposed pump.

In some cases, the systems and techniques of the invention can be used to cement or fortify at least a portion of a subsurface structure or formation. For example, the swellable polymeric material can be disposed against regular or expendable casing structures or components to close any undesirable perforations in water-producing zones of a wellbore.

Further aspects can involve utilizing the systems and techniques of the invention to inhibit, at least partially, an undesirable component and favor transport of a desirable component. Thus, in some cases, the polymeric materials of the invention can, when disposed against a producing zone of a structure, be comprised of and constructed to inhibit the flow of an aqueous component and preferentially allow flow therethrough an organic or non-aqueous component. For example, the polymeric material can comprise at least one swellable component and at least one non-swelling component. The swelling component can be activated, e.g., by absorbing the non-aqueous components at a first region and allowing permeation therethrough to another region while inhibiting the aqueous components. The systems and techniques of the invention can thus inhibit the transport of one or more undesirable components while preferentially allowing the transport of other components. The preferential transport characteristics of the polymeric material can be, in some cases, effected by the plurality of channels or conduits.

Further aspects of the invention pertain to systems and techniques that temporarily seal or inhibit fluid flow. For example, the materials of the invention can be comprised of polymeric components that swell rapidly, e.g., having a volumetric increase of at least about 25% within thirty minutes or less, and then decompose to a state that no longer seals or inhibits fluid flow. For example, the systems and techniques of the invention can involve or utilize a polymeric material comprising at least one phase having an affinity for at least one of an aqueous and a non-aqueous fluid. The polymeric material, upon exposure to the absorbed fluid swells and retains at least a fraction of its mechanical properties for a desired period of time. For example, organic based fluids can be absorbed by a polymeric material having a swellable phase comprising polyisoprene. The swellable phase, after absorbing the oil, loses tensile strength and effectively dissolves in the organic fluid. Thus, the polymeric material can serve to temporarily seal a portion of a formation permeating the organic fluid.

Figure 8:
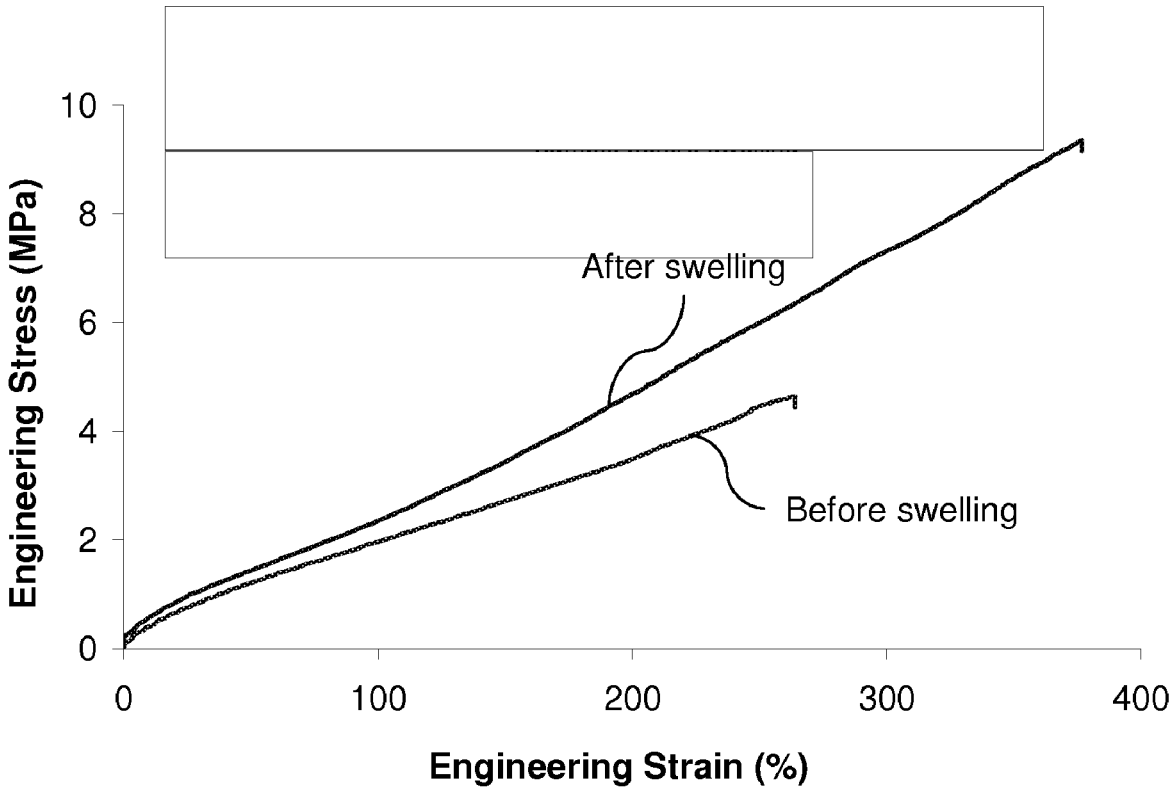
FIG. 8 is a chart showing the stress-strain properties of a polymeric material of the invention before and after swelling.

As illustrated in FIG. 8, the mechanical properties of a polymeric material in accordance with one or more aspects of the invention are illustrated. The polymetric material illustrated in FIG. 8 may be used in conjunction with any of the applications of a swellable polymetric recited herein. In the present embodiment, the polymetric material comprises a swellable phase and a non-swelling phase. As evidenced in FIG. 8, upon expose of the polymetric material to a swelling fluid the tensile strength and strain capabilities are increased as compared to the non-swelled polymetric material. Such increases in tensile strength and strain capabilities can be utilized by one skilled in the art when practicing the present invention.

As used herein, the term "plurality" refers to two or more items or components.

The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims.

Having now described some illustrative embodiments of the invention, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives.

Further, acts, elements, and features discussed only in connection with one embodiment are not intended to be excluded from a similar role in other embodiments.

It is to be appreciated that various alterations, modifications, and improvements can readily occur to those skilled in the art and that such alterations, modifications, and improvements are intended to be part of the disclosure and within the spirit and scope of the invention. Moreover, the invention contemplates the modification of existing structures to retrofit one or more systems, subsystems, or components and implement the techniques of the invention. It should also be appreciated that the invention is directed to each feature, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the invention as embodied in the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize or be able to ascertain, using no more than routine experimentation, equivalents to the specific embodiments of the invention. It is therefore to be understood that the embodiments described herein are presented by way of example only and that, within the scope of the appended claims and equivalents thereto; the invention may be practiced otherwise than as specifically described.

What is claimed is:

1. A seal comprising:

a polymeric material having a first phase with a first swelling characteristic;

a second phase with a second swelling characteristic;

the first swelling characteristic is greater than the second swelling characteristic when the polymeric material is exposed to a swelling fluid and wherein said polymeric material is selected to provide a volumetric increase to a first state for an initial period of time, then decompose to a second state that no longer seals or inhibits fluid flow.

2. The seal of claim 1, wherein said seal is a wellbore seal and said swelling fluid is a formation fluid.

3. The seal of claim 1, wherein the polymeric material is a copolymer comprising the first phase and the second phase.

4. The seal of claim 1, wherein the first phase comprises hydrogenated acrylonitrile-butadiene and the second phase comprises a poly styrene-butadiene.

5. The seal of claim 1, wherein the second phase comprises poly ethylene-propylene.

6. The seal of claim 1, wherein said polymeric material inhibits flow of an undesirable component through the seal and favor transport of a desirable component through the polymetric material.

7. A seal tool comprising a swellable layer, a supporting assembly disposed adjacent the swellable layer, and an inflatable bladder, wherein the swellable layer comprises a polymeric material having a first phase having a first swelling characteristic and a second phase having a second swelling characteristic, the first swelling characteristic is greater than the second swelling characteristic when exposed to a swelling fluid and wherein the support assembly comprises a plurality of overlayed wire-mesh structures.

8. The seal tool of claim 7, wherein the supporting assembly comprises an expandable structure constructed to conform with an actuated geometry of the bladder.

9. The seal tool of claim 7, wherein said polymeric material inhibits an undesirable component and favor transport of a desirable component through the polymeric material.

10. The seal tool of claim 7, wherein said polymeric material comprises polymeric components selected to provide a volumetric increase to a first state for an initial period of time, then decompose to a second state that no longer seals or inhibits fluid flow.

11. The seal tool of claim 7, wherein said seal tool is a wellbore seal tool and said swelling fluid is a formation fluid.

12. A method of sealing an upper portion from a lower portion of a wellbore having a production tubing assembly disposed therein, comprising:

disposing a swellable polymeric material against an outer surface of the production tubing assembly and a wall of the wellbore, the swellable polymeric material comprising:

a first phase having a first swelling characteristic;

a second phase having a second swelling characteristic, wherein the first swelling characteristic is greater than the second swelling characteristic when the swellable polymeric material is exposed to a formation fluid in the wellbore;

promoting a bulk volumetric increase of the polymeric material to seal the upper portion from the lower portion for an initial period of time then decomposing to a second state that no longer seals or inhibits fluid flow.

13. The method of claim 12, wherein the act of disposing the swellable polymeric material comprises providing the polymeric material as a copolymer comprising the first phase and the second phase.

14. The method of claim 13, wherein the act of promoting a bulk volumetric change comprises exposing the polymeric material to the formation fluid.

15. A method of sealing at least a portion of a wall of a wellbore comprising:

disposing a swellable polymeric material against at least a portion of the wall, the swellable polymeric material comprising a first phase having a first swelling characteristic and a second phase having a second swelling characteristic, the first swelling characteristic is greater than the second swelling characteristic when the swellable polymeric material is exposed to a formation fluid, supporting the swellable polymeric material against the portion of the wall with a support assembly;

an expanding the support assembly against the swellable polymeric material thereby securing the sealant against the wall.

16. The method of claim 15, wherein act of disposing the swellable polymeric material comprises providing the swellable polymeric material as a copolymer of the first phase and the second phase.

17. The method of claim 15, wherein the act of supporting the swellable polymeric material comprises energizing an expandable structure disposed adjacent the support assembly thereby creating an applied pressure on the swellable polymeric material.

18. The method of claim 15, wherein the support assembly comprises a plurality of wire mesh layers.

19. The method of claim 15, wherein the act of supporting the swellable polymeric material comprises energizing an inflatable bladder that is at least partially contained within the support assembly.

* * * * *